US011732451B2

(12) United States Patent
Stein

(10) Patent No.: US 11,732,451 B2
(45) Date of Patent: Aug. 22, 2023

(54) SANITARY FIXTURE

(71) Applicant: Neoperl GmbH, Mullheim (DE)

(72) Inventor: Alexander Stein, Ihringen (DE)

(73) Assignee: NEOPERL GMBH, Mullheim (DE)

( * ) Notice: Subject to any disclaimer, the term of this patent is extended or adjusted under 35 U.S.C. 154(b) by 745 days.

(21) Appl. No.: 16/328,005

(22) PCT Filed: Mar. 13, 2018

(86) PCT No.: PCT/EP2018/056206
§ 371 (c)(1),
(2) Date: Feb. 25, 2019

(87) PCT Pub. No.: WO2018/167042
PCT Pub. Date: Sep. 20, 2018

(65) Prior Publication Data

US 2021/0388586 A1 Dec. 16, 2021

(30) Foreign Application Priority Data

Mar. 13, 2017 (DE) ..... 202017101442.8

(51) Int. Cl.
*E03C 1/086* (2006.01)
*E03C 1/084* (2006.01)
*E03C 1/02* (2006.01)

(52) U.S. Cl.
CPC ..... *E03C 1/084* (2013.01); *E03C 1/086* (2013.01); *E03C 2001/026* (2013.01)

(58) Field of Classification Search
CPC . E03C 1/084; E03C 1/086; E03C 1/08; E03C 2201/40; E03C 2001/026; B05B 1/3006; B05B 1/1609; B05B 7/0425
See application file for complete search history.

(56) References Cited

U.S. PATENT DOCUMENTS

| | | | | |
|---|---|---|---|---|
| 5,114,072 | A * | 5/1992 | Barhydt, Sr. | E03C 1/08 239/533.1 |
| 6,126,073 | A | 10/2000 | Rowlands | |
| 6,874,711 | B2 | 4/2005 | Dieterle et al. | |
| 6,892,964 | B2 | 5/2005 | Grether et al. | |
| 9,657,467 | B2 | 5/2017 | Stein et al. | |
| 2012/0018661 | A1* | 1/2012 | Kao | E03C 1/08 251/359 |
| 2013/0134235 | A1* | 5/2013 | Blum | B05B 1/3402 239/428.5 |

(Continued)

FOREIGN PATENT DOCUMENTS

| | | |
|---|---|---|
| CN | 1460144 | 12/2003 |
| CN | 1633874 | 7/2005 |
| CN | 201272993 | 7/2009 |

(Continued)

*Primary Examiner* — Christopher R Dandridge
(74) *Attorney, Agent, or Firm* — Volpe Koenig

(57) ABSTRACT

A sanitary fixture (1) is provided having a diffuser (3) arranged behind a functional unit (2) and an annular chamber (24) arranged behind the diffuser (3), an area of an opening cross-section of an outlet opening (9) of the diffuser (3) is at most 10% greater than an area of an opening cross-section of an inlet opening (5, 5') of the diffuser (3) and/or the annular chamber (24) with a contour, which in a longitudinal section of the fixture (1), follows an ellipse (26, 28) having the smallest possible eccentricity.

20 Claims, 10 Drawing Sheets

(56) References Cited

U.S. PATENT DOCUMENTS

2016/0222639 A1 8/2016 Stein

FOREIGN PATENT DOCUMENTS

| | | | | |
|---|---|---|---|---|
| CN | 103968109 | | 8/2014 | |
| CN | 205003556 | | 1/2016 | |
| CN | 109642422 | | 4/2021 | |
| DE | 10027987 | | 12/2001 | |
| DE | 20304659 | | 7/2004 | |
| DE | 202015000856 | | 6/2016 | |
| EP | 2597214 | | 5/2013 | |
| KR | 20000049073 | | 7/2000 | |
| WO | 2005118968 | | 12/2005 | |
| WO | WO2005118968 | * | 12/2005 | ..... E03C 1/084 |

* cited by examiner

Prior Art

SANITARY FIXTURE

BACKGROUND

The invention relates to a sanitary installation part, having a functional unit and having a diffuser formed downstream of the functional unit, wherein the functional unit forms at least one inlet opening to a diffuser space, wherein the diffuser has a baffle plate which delimits the diffuser space in an incident-flow direction predefined by the at least one inlet opening, which baffle plate diverts water flowing in through the at least one inlet opening in a lateral direction, wherein the diffuser space is formed between the baffle plate and the functional unit and has an outlet opening through which water entering through the at least one inlet opening emerges in its entirety from the diffuser space.

DE 20 2015 000 856 U1 has disclosed a sanitary outlet element in which a flow regulator or a flow restrictor is, by way of a restrictor or regulator housing, guided displaceably in the insert housing and movable from an open position, in which the restrictor or regulator housing is flowed around by at least a partial quantity of the water, counter to a restoring force of at least one restoring element into a closed position, in which the water flowing to the jet regulator flows through the flow regulator or the flow restrictor.

SUMMARY

The invention is based on the object of improving the jet pattern of an emerging water jet.

To achieve the stated object, a sanitary installation part with one or more features of the invention is provided. In particular, according to the invention, to achieve the stated object in the case of a sanitary installation part of the type described in the introduction, it is thus provided that an opening cross section of the outlet opening has an area which amounts to 0.9 times to 2 times, preferably 1 times to 1.7 times, an area of an opening cross section of the at least one inlet opening. Thus, restricted space conditions are created in the diffuser space, by which turbulence in a water flow can be prevented. The areas are preferably selected to be approximately or even exactly equal.

If two or more inlet openings arranged separately from one another are provided, then, as an area of the at least one inlet opening, a total area of the two or more inlet openings can be used for the described size proportions.

In an embodiment of the invention which is possibly of independent inventive quality, in the case of a sanitary installation part of the type described in the introduction or in the case of the exemplary embodiment described above, provision may be made whereby the baffle plate is, at a side facing toward the diffuser space, formed so as to be substantially (or even exactly) planar. Thus, undesired turbulence that could be caused by structures on the baffle plate can be avoided.

Alternatively or in addition, provision may be made whereby the baffle plate is, at a side facing toward the diffuser space, formed so as to be substantially (or even entirely) free from obstructions. The invention has recognized that, for good subsequent aeration, jet splitting in the region of the baffle plate can be dispensed with. Thus, the invention can, in a simple manner, realize a substantially or completely obstruction-free diversion of the flowing water after it emerges from the inlet opening.

In an embodiment of the invention which is possibly of independent inventive quality, in the case of a sanitary installation part of the type described in the introduction or in the case of one of the exemplary embodiments described above, provision may be made whereby the diffuser space has at least two inlet openings which are spaced apart from one another along a main flow direction, and whereby the diffuser space has, along the main flow direction, a profile which defines a profile widening between the mutually spaced-apart inlet openings and/or at the downstream one of the at least two inlet openings. Thus, increases in a water flow that arise along the main flow direction as a result of further inlet openings can be easily accommodated by a corresponding increase in a cross-sectional area of the diffuser space. Undesired turbulence at an inlet opening can thus be avoided. Here, the main flow direction can be described as a preferably shortest connecting line between an inlet opening, preferably an inlet opening arranged furthest upstream, and the abovementioned outlet opening of the diffuser space. Due to the straightening effect of the correspondingly dimensioned diffuser space, this may correlate with the average flow velocity direction in angle segment comprising the inlet opening.

The profile widening is preferably in the form of a profile ramp. In this way, a step-free profile can be provided, such that the water can flow with little turbulence or no turbulence in the diffuser space.

Provision may be made here whereby the profile widening defines an enlargement of a cross-sectional area of the diffuser space transversely with respect to the main flow direction, which is adapted to a cross-sectional area of the downstream inlet opening. It can thus be easily achieved that the water entering via this downstream inlet opening can be merged with the least possible turbulence with the water from the upstream inlet opening. From the continuity equation, it follows that speed profiles which vary as a result of the increase in cross-sectional area, and/or sudden increases in speed, can be avoided. Turbulence can thus be reduced.

In one embodiment of the invention, provision may be made whereby the baffle plate is delimited on all sides, that is to say in encircling fashion, by a cross-sectional widening for the flowing water. An obstruction-free limitation of the baffle plate can thus be realized. It can be achieved in particular that the flowing water can thus flow out of the baffle plate in an unobstructed manner.

The cross-sectional widening is preferably formed by a (descending) step. Desired turbulence downstream of the baffle plate, by which air is admixed, can thus be easily realized.

In one embodiment of the invention, provision may be made whereby the at least one inlet opening is arranged opposite the baffle plate. A flow directly incident on the baffle plate for a diversion of the flow direction toward the outside can thus be realized. The at least one inlet opening is preferably oriented along a longitudinal direction of the sanitary installation part.

In one embodiment of the invention, provision may be made whereby the at least one inlet opening is arranged in the middle with respect to the baffle plate. Thus, rotationally symmetrical flow conditions can be realized. Swirl formation can thus be avoided or at least reduced.

In one embodiment of the invention, provision may be made whereby a carrier plate of the functional unit is supported on the baffle plate. Forces introduced onto the functional unit by the flowing water can thus be dissipated. The support is preferably realized in the middle on the baffle plate. This permits a symmetrical, in particular rotationally symmetrical, design of the diffuser space.

In one embodiment of the invention, provision may be made whereby a flow divider is formed on the baffle plate centrally with respect to the inlet opening, which flow divider can serve as a filling element and thus prevent undesired flow effects. Thus, a reference point can be formed, relative to which a flow in the diffuser space is aligned. Circular flows or turbulence at a first point of impingement of the water against the baffle plate can thus be avoided. The impinging jet naturally already has a cross section of a (possibly deformed) circular disk, in which water in each circular disk segment can be easily diverted outward in a particular direction. For example, the flow divider may be formed by the support already mentioned. The structural design can thus be kept simple.

In one embodiment of the invention, provision may be made whereby the functional unit has at least one flow regulator. It is advantageous here that a required or desired throughflow rate can be provided within a working range irrespective of pressure. The flow conditions in the diffuser space can thus be easily controlled.

Alternatively or in addition, the functional unit may have at least one restrictor. Throughflow rates in the diffuser space can thus be reduced in relation to an unhindered throughflow.

In one embodiment of the invention, provision may be made whereby the functional unit has two flow regulators which are positioned in parallel in a flow direction. It is thus possible to provide greater throughflow rates irrespective of pressure. The flow regulators are preferably arranged concentrically with respect to one another. Structural space can thus be saved without the need for control elements of the flow regulators to be of very small dimensions. Here, the two flow regulators may form in each case one inlet opening into the diffuser space. Here, for example if the flow regulators are arranged concentrically with respect to one another, the inlet openings may be arranged spaced apart from one another along the abovementioned main flow direction, and thus form an upstream and a downstream inlet opening.

In one embodiment of the invention, provision may be made whereby a jet aerating device is positioned downstream of the diffuser. An aerated jet can thus be provided. The uniform or turbulence low-flow, according to the invention, in the diffuser space has proven to be particularly expedient for a downstream air enrichment.

In one embodiment of the invention, provision may be made whereby the diffuser space has a substantially (or even exactly) constant height. Turbulence can thus be avoided or at least reduced also in a vertical direction (in relation to the baffle plate and/or an extent of the diffuser space). The height of the diffuser space may be characterized for example as a dimension transversely with respect to the flow direction in the diffuser space and/or transversely with respect to an extent direction of the baffle plate.

In one embodiment of the invention, provision may be made whereby the diffuser space forms a flow straightener. It is thus possible to realize uniform, in each case for example radially oriented partial flows at the outlet opening, which are expedient for a downstream jet forming process. For this purpose, the diffuser space is preferably designed to have few obstructions or even be free from obstructions, in order to as far as possible avoid undesired turbulence. Here, the invention makes use of the fact that the flow straightening effect is generated by virtue of the delimiting walls of the diffuser space, which forms a channel, being oriented and dimensioned in the described manner.

In one embodiment of the invention, provision may be made whereby a height of the diffuser space amounts to less than half of the height of a collecting chamber positioned downstream. A relatively narrow diffuser space has proven to be expedient for the generation of a straightened flow. Here, the expression "straightened" may also encompass flow patterns in which the partial flows are oriented not parallel but radially in relation to a center.

The invention generally has the advantage that, due to the constricted embodiment, an as far as possible uniform flow pattern in the diffuser space can be realized.

In general, it can be stated that the described features individually or in combination with one another can serve for generating an extremely homogenous speed profile. Large differences in speeds between adjacent partial flows have a tendency to generate turbulence. The invention provides measures for preventing the occurrence of large speed differences.

To achieve the stated object in a manner which is possibly of independent quality, the invention provides a sanitary installation part in which an annular chamber is positioned downstream, in a flow direction, of a diffuser, which annular chamber opens into at least one outlet nozzle, wherein, downstream of the at least one outlet nozzle, there is formed at least one aeration opening via which air from the outside can be supplied for the purposes of generating an aerated water jet, that the annular chamber has, above the at least one outlet nozzle, in one longitudinal portion, a contour into which there can fit an ellipse which has a side ratio of greater than 0.433 of a semi-minor axis in relation to a semi-major axis. It is advantageous here that the annular chamber provides a space for inflowing water, which permits a flow pattern which is approximately circular in a longitudinal section, and at the same time allows for the constricted space conditions of a sanitary installation part. Such a flow pattern is particularly expedient for effective admixing of air.

An ellipse that fits may for example be characterized as being the preferably largest ellipse in terms of area which, at four points, makes contact with a contour or boundary line, approximated in particular as a tetragon, of a cross section transverse with respect to the encircling chamber of the annular chamber.

In general, it can be stated that the flow pattern is all the more expedient for effective admixing of air the closer the ratio of the semi-axes is to 1. Further conditions must however also be taken into consideration here, for example the requirement for the smallest possible outer dimension of the installation part transversely with respect to the longitudinal or flow direction. In many cases, these make it impossible to actually attain the side length ratio of 1.

The numeric ratio preferably amounts to more than or equal to 0.45, 0.5 or even 0.6. It is thus possible for even approximately or exactly circular flow patterns to be realized.

To achieve the stated object in a manner which is possibly of independent inventive quality, the invention provides alternatively or in addition to the solution described above, a sanitary installation part in which an annular chamber is positioned downstream, in a flow direction, of a diffuser, which annular chamber opens into at least one outlet nozzle, wherein, downstream of the at least one outlet nozzle, there is formed at least one aeration opening via which air from the outside can be supplied for the purposes of generating an aerated water jet, wherein, between the diffuser and the annular chamber, there is formed a guide surface which guides inflowing water into the annular chamber, that the annular chamber has, in an annular chamber part situated above an elongation of the guide surface into the annular chamber, in one longitudinal portion, a contour into which there can fit an ellipse which has a side ratio of greater than 0.52 of a semi-minor axis in relation to a semi-major axis.

The invention has recognized that the water flows from the guide surface into the annular chamber, such that the described geometrical cross-sectional shape is expedient in order to force this water into an approximately circular path.

It is preferable if the side ratio amounts to more than 0.55, or is equal to 0.55. It is particularly preferable if the side ratio amounts to more than 0.6, or is equal to 0.6. It is very particularly preferable if the side ratio amounts to more than 0.69, or is equal to 0.69. This permits an even better approximation to the circular path, and thus further improved aeration.

In one embodiment of the invention, provision may be made whereby the annular chamber has a tetragonal, in particular (substantially or even exactly) parallelogram-shaped, longitudinal section. A parallelogram-shaped cross-sectional form can be realized particularly easily and can provide sufficient space for good swirling of the water with inflowing air. The longitudinal section may thus be selected to be transverse with respect to a (for example circular) extent dimension of the annular chamber.

In general, an annular chamber enlarged in accordance with the invention may be realized for example by virtue of a step-like constriction being formed upstream of the outlet nozzle.

In one embodiment of the invention, provision may be made whereby an upper cover is placed onto projections which project into the annular chamber. The annular chamber can thus be formed with a maximum extent radially with respect to the longitudinal direction of the installation part, without being limited by a cover situated above it and supported thereby. The functional unit is preferably formed on the cover. Thus, the diffuser bears the functional unit. Here, the projections may be of plate-like form. This can improve turbulence by virtue of a water flow running in the extent direction or along the annular chamber being deflected laterally.

In one embodiment of the invention, provision may be made whereby, downstream of the outlet nozzle, multiple aeration openings are arranged so as to be distributed over a circumference of the installation part. It is thus possible to provide a supply of air on all sides. The invention has recognized that the admixing of air takes place already in the annular chamber upstream of the outlet nozzle, wherein the air enters the annular chamber through the outlet nozzle—counter to the flow direction of the water.

The aeration openings are preferably formed at uniform intervals. The annular chamber can thus be supplied with air uniformly.

In one embodiment of the invention, provision may be made whereby the outlet nozzle is formed by an annular gap. It is thus possible to avoid further subdivisions of the aerated jet.

In one embodiment of the invention, provision may be made whereby the annular chamber is, in a longitudinal section, arranged so as to be offset downward in relation to a collecting chamber positioned upstream. This permits an inflow of the water approximately into a vertically middle region of the annular chamber. This is expedient for good admixing of air.

In one embodiment of the invention, provision may be made whereby the annular chamber extends above and below a or the guide surface. It can thus be achieved that the water enters in a manner spaced apart from a boundary of the annular chamber. This is expedient for good turbulence for admixing of air.

In one embodiment of the invention, provision may be made whereby multiple mutually spaced-apart passage openings are formed between the collecting chamber and the annular chamber. It can thus be achieved that mutually spatially separate partial flows enter the annular chamber. This can be utilized, in the case of a lateral deflection along the annular chamber, for a generation of partial flows which impinge on one another. Yet further improved turbulence for the purposes of jet aeration can thus be achieved. The described passage openings are ideally combinable with the likewise described guide surface and/or with the likewise described offset arrangement of annular chamber and collecting chamber, in order to achieve that partial flows of the water enter the annular chamber approximately in the middle or only slightly eccentrically. Particularly effective admixing of air can be achieved in this way.

BRIEF DESCRIPTION OF THE DRAWINGS

The invention will now be discussed in more detail on the basis of exemplary embodiments, but is not restricted to these exemplary embodiments. Further exemplary embodiments will emerge from combination of the features of individual or several patent claims with one another and/or with individual or several features of the exemplary embodiments.

In the figures.

DETAILED DESCRIPTION

Figure 1:
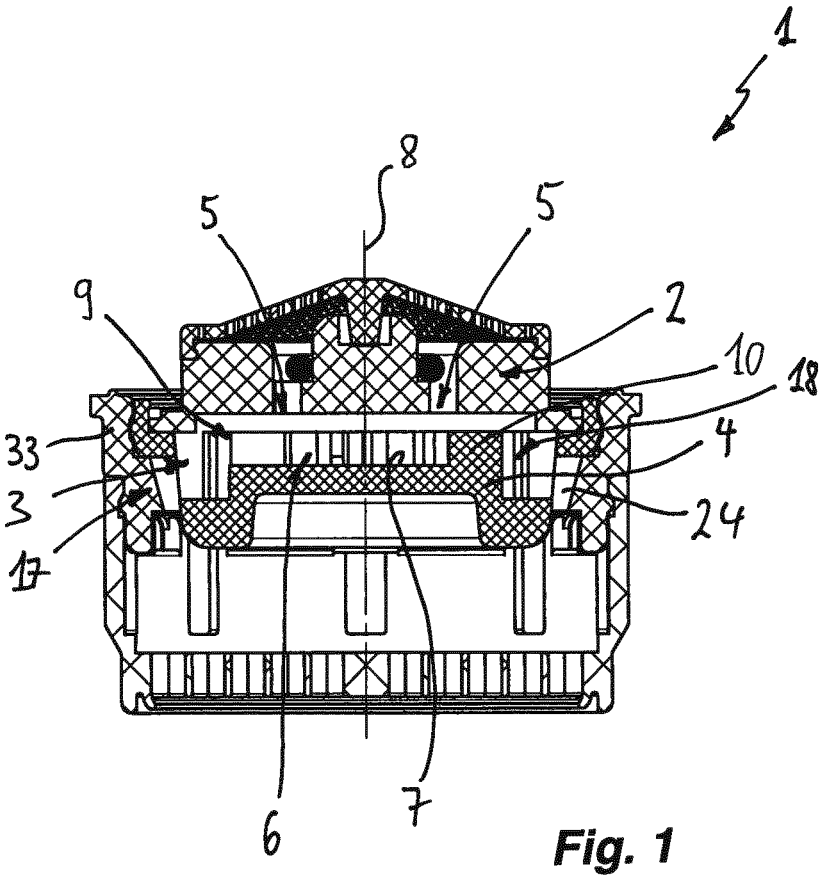
FIG. 1 shows a sanitary installation part according to the prior art.

FIG. 1 shows a sanitary installation part according to the prior art denoted as a whole by 1. The installation part 1 has a functional unit 2 and a diffuser 3, which is arranged downstream of the functional unit 2 in a flow direction. Here, the diffuser 3 is formed on a diffuser insert 4.

Here, the functional unit 2 opens via a circular inlet opening 5 into the diffuser space 6 of the diffuser 3.

The diffuser space 6 is delimited by a baffle plate 7, on which flow can be incident through the inlet opening 5.

This baffle plate 7 diverts the entering water in a lateral, radial direction.

The diffuser space 6 is arranged between the baffle plate 7 and the functional unit 2 and is delimited in a radial direction, defined in relation to a central axis 8, by an outlet opening 9. This outlet opening 9 encircles the diffuser space 6 on a cylinder envelope.

In an outflow direction predefined by the inlet opening 5, the baffle plate 7 delimits the diffuser space 6.

On the baffle plate 7, there are formed multiple flow obstructions 10 each with a triangular horizontal section, which flow obstructions divide the water diverted at the baffle plate 7 into multiple individual partial flows.

Here, the flow obstructions 10 are arranged spaced apart from the functional unit 2, such that it is also possible for water to flow over the flow obstructions 10.

FIGS. 2 to 6 show different views of a sanitary installation part according to the invention. These figures will be described jointly below.

Components and functional units which are similar or identical in terms of construction and/or function to the installation part as per FIG. 1 above are denoted by the same reference designations and will not be described separately again. The statements relating to FIG. 1 therefore apply correspondingly to FIGS. 2 to 6.

The exemplary embodiment according to the invention differs from the prior art as per FIG. 1 in that the opening cross section of the outlet opening 9 has an area which exceeds an area of an opening cross section of the inlet opening 5 by at most 10%. In the present exemplary embodiment, the areas are even selected to be equal.

By contrast to the variant as per FIG. 1, in which flow obstructions 10 were arranged on the baffle plate 7, the baffle plate 7 is of planar and obstruction-free form on the side facing toward the diffuser space 6.

This has the result that the outlet opening 9 is formed so as to be open in an encircling manner at the outer edge 11 of the baffle plate 7.

Situated radially outside the edge 11 is a step 12 which slopes downward. This step 12 thus forms a cross-sectional widening in relation to the opening cross section of the outlet opening 9.

The cross-sectional widening formed in this way is formed in an encircling manner around the entire baffle plate 7.

By use of the step 12, the outer edge 11 forms an encircling separation edge over which the water flow flows downward.

This is particularly expedient for the initiation of the turbulence, which will be described further below.

Figure 3:
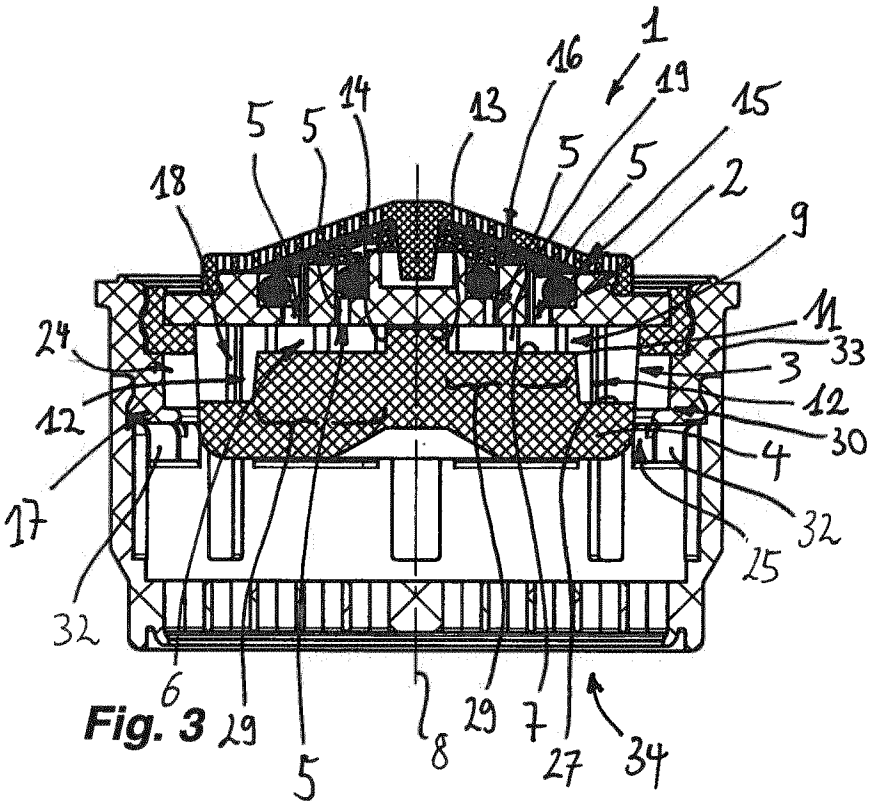
FIG. 3 shows the installation part according to the invention as per FIG. 2 in a longitudinal sectional illustration.
Figure 4:
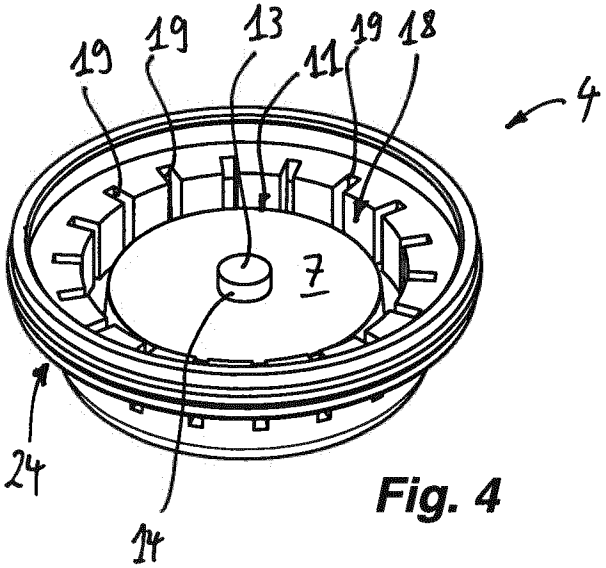
FIG. 4 shows a perspective view of the diffuser insert with baffle plate and collecting chamber of the installation part as per FIG. 1.
Figure 6:
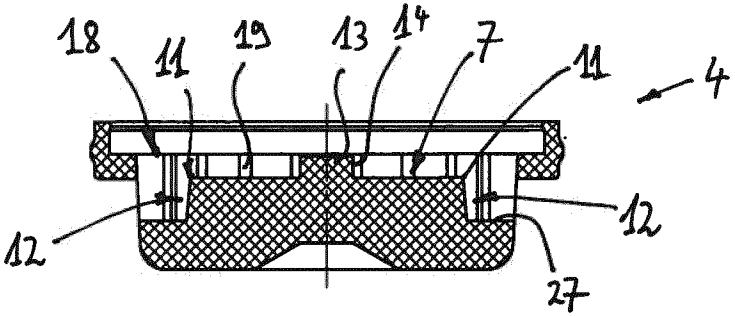
FIG. 6 shows a longitudinal section through the diffuser insert as per FIG. 5 along the section plane A-A.
Figure 5:
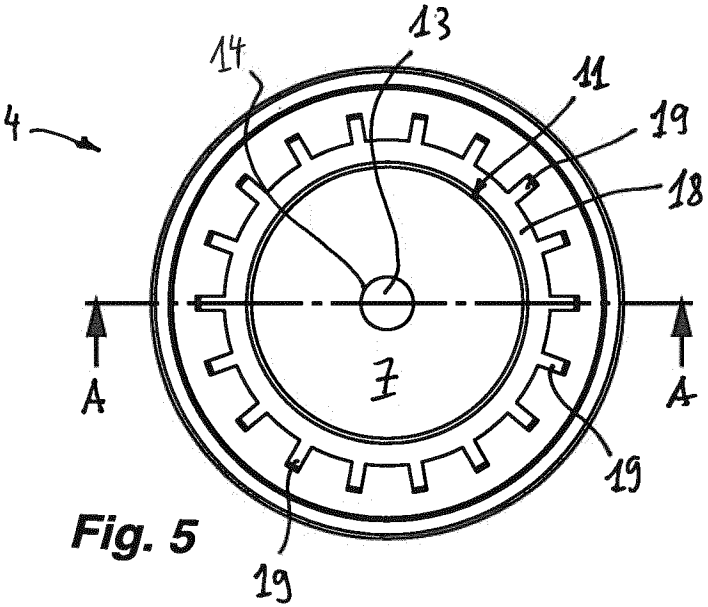
FIG. 5 shows a view from above of the diffuser insert as per FIG. 4.
Figure 7:
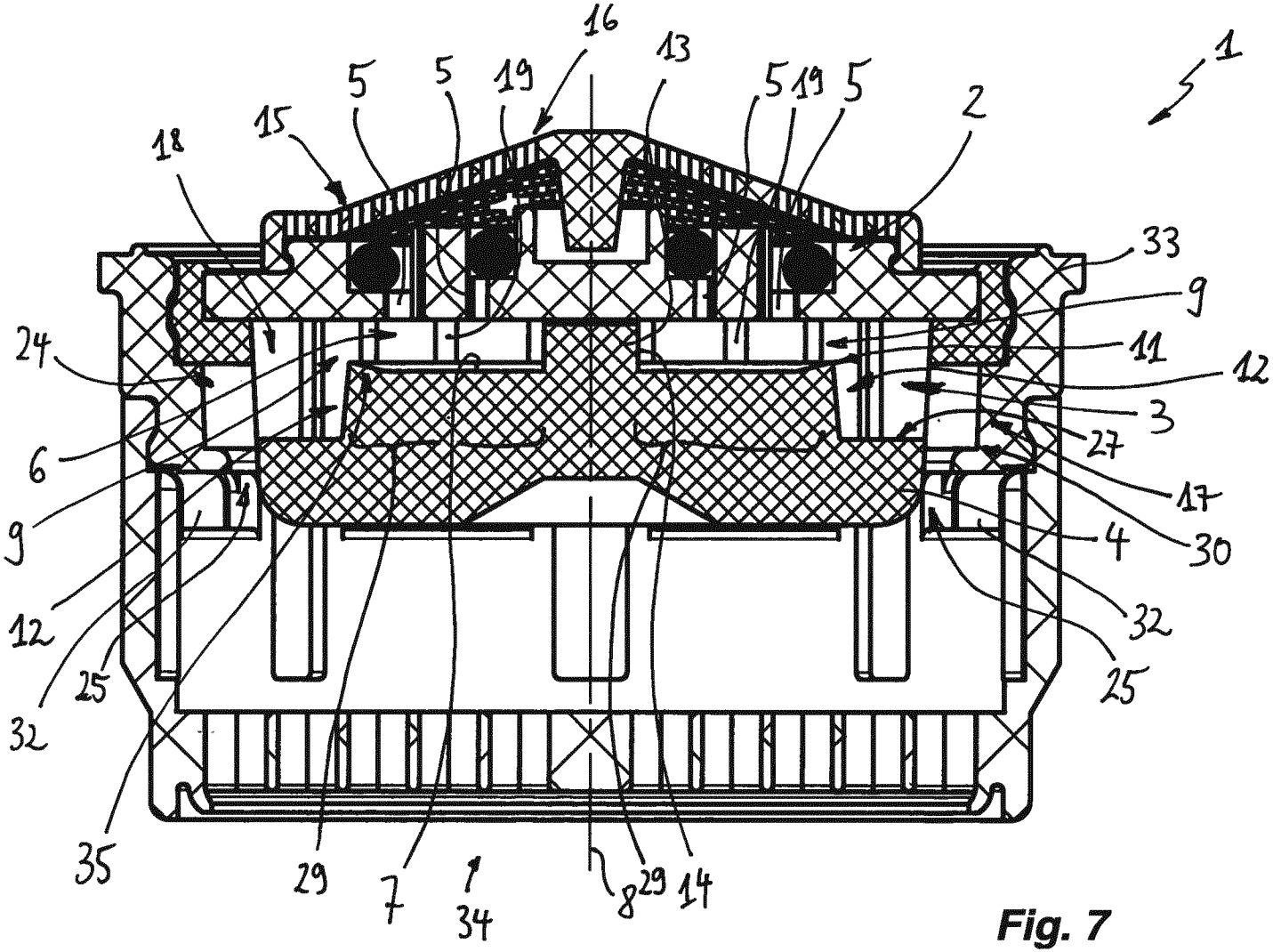
FIG. 7 shows a longitudinal section through a further sanitary installation part according to the invention.
Figure 8:
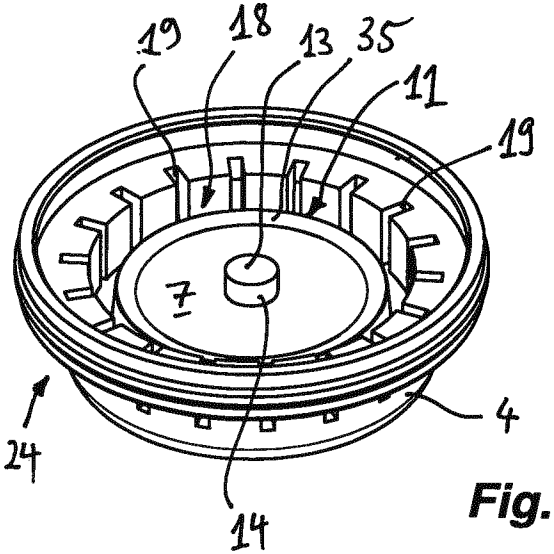
FIG. 8 shows a perspective view of the diffuser insert of the installation part as per FIG. 7.
Figure 10:
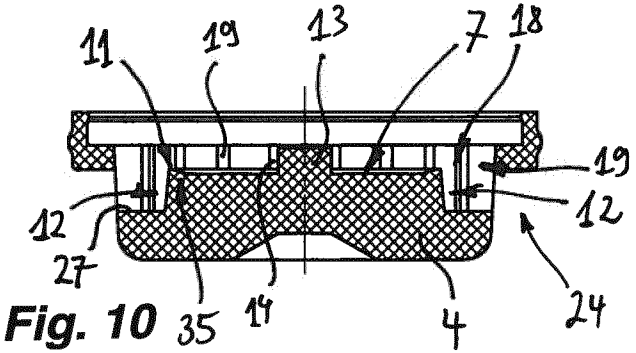
FIG. 10 shows a longitudinal section along B-B through the diffuser insert as per FIG. 9.
Figure 9:
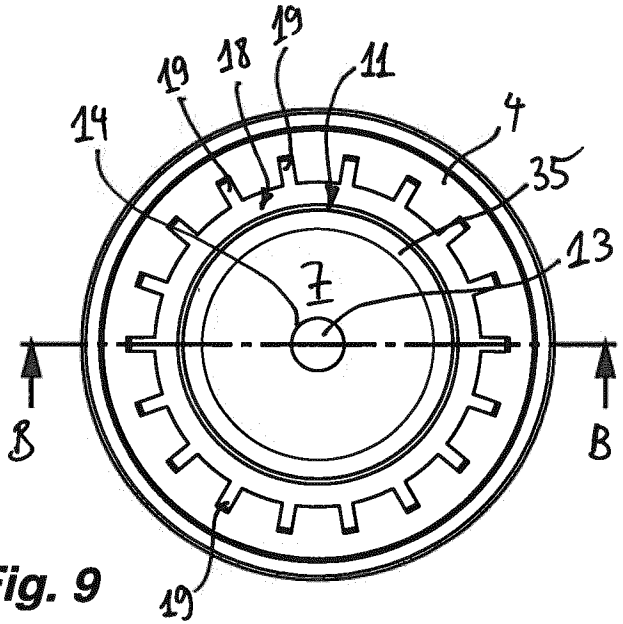
FIG. 9 shows a view from above of the diffuser insert as per FIG. 8.

It can be seen in FIG. 3 that the baffle plate 7 is arranged relative to the inlet opening 5 such that the inlet opening 5 is situated in the middle or centrally, that is to say in this case concentrically, with respect to the baffle plate 7.

On the baffle plate 7, there is formed a central support 13 which supports the functional unit 2. In further exemplary embodiments, the central support 13 may also be formed integrally on the functional unit 2 and seated on the baffle plate 7 or may engage into a recess formed there.

This support 13 forms a flow divider 14 which prevents water flowing from the inlet opening 5 from being able to flow to the central axis 8 and across the central axis 8. Rather, the flow divider 14 has the effect that the inflowing water is diverted radially substantially rectilinearly outward from the inlet openings 5. The flow divider 14 furthermore fills a central region, which is not required and in which there is a risk of turbulence forming, of the diffuser space 6.

By the support 13, the housing, formed as a carrier plate 37, of the flow regulators 15, 16 is also supported centrally on the baffle plate 7.

In the exemplary embodiment as per FIGS. 2 to 6, the functional unit 2 has two flow regulators 15, 16. Here, the flow regulators 15, 16 are each equipped, in a manner known per se, with an elastically deformable regulating body as regulating element 22, 23, which in a pressure-dependent manner adjusts an opening cross section of a control gap formed downstream of the regulating body. The regulating elements 22, 23 are each arranged in an annular gap 20, 21. For a space-saving arrangement, the flow regulators 15, 16 are arranged concentrically one inside the other and in a nested configuration. Said regulating gaps jointly form the inlet opening 5.

In further exemplary embodiments, other flow regulators or combinations of flow regulators and restrictors, or only restrictors, are provided.

A jet aerating device 17 is positioned downstream of the diffuser 3 in a flow direction in FIGS. 2 to 6. The jet aerating device 17 has a collecting chamber 18 which is positioned downstream of the diffuser space 6 and which is opened up by the abovementioned step 12. This collecting chamber 18 is of annular encircling form and opens into an annular chamber 24 via a multiplicity of radial passage openings 19. Here, the annular chamber 24 is of annular encircling form and may be continuously open or formed so as to be partially interrupted by intermediate portions. In the present exemplary embodiment, the annular chamber 24 is of continuously open form.

Positioned downstream of the annular chamber 24 is an outlet nozzle 25 which is formed as an annular gap and which follows the profile of the annular chamber 24.

Below the outlet nozzle 25, there are formed outwardly leading aeration openings 32 which extend in a uniformly distributed manner along the circumference.

Through this aeration opening 32, air from the outside enters via the outlet nozzle 25—that is to say counter to the flow direction of the water—into the annular chamber 24, in which said air is mixed with the water sputtering past.

On the other side of the flow divider 14, the diffuser space 6 has a constant height, that is to say vertical dimension, and thus forms a flow straightener which has few obstructions, and which is preferably free from obstructions.

Here, the height of the diffuser space 6, that is to say its extent along the central axis 8 or in the longitudinal direction, is smaller than half of the height of the downstream collecting chamber 18, that is to say of the extent thereof along the central axis 8.

Figure 2:
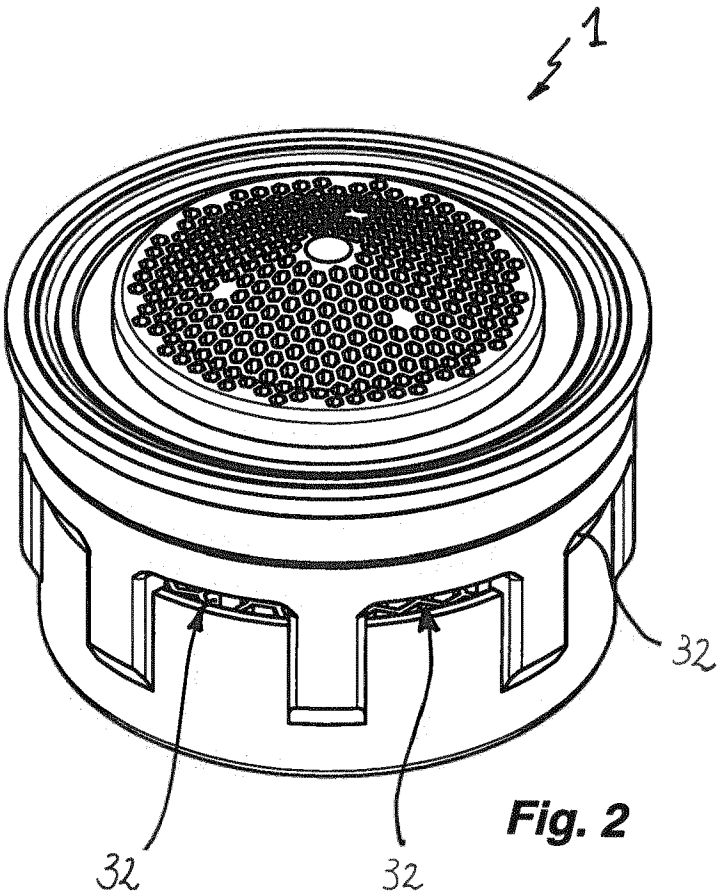
FIG. 2 shows a sanitary installation part according to the invention in a perspective view from above.
Figure 13:
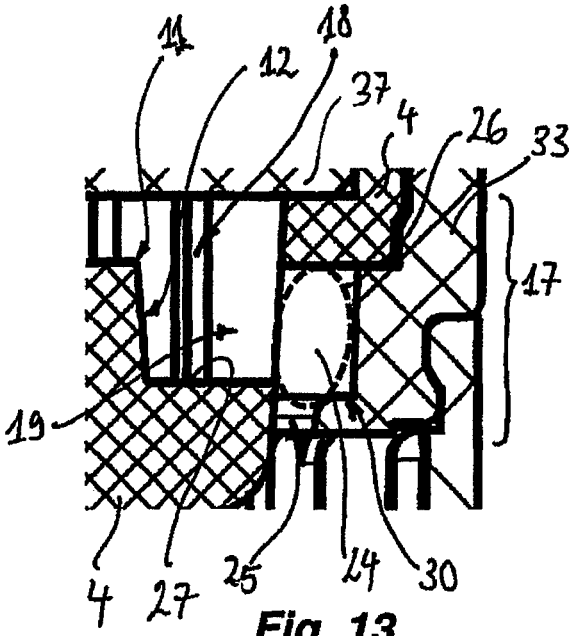
FIG. 13 shows a detail from FIG. 3 with a large ellipse fitted therein.

FIG. 13 shows an enlarged illustration from FIG. 2.

Into the cross section of the annular chamber 24 there is fitted or inscribed an ellipse 26, whose side ratio of the length of the semi-minor axis to the semi-major axis is equal to 0.53 and thus amounts to more than 0.433. In further exemplary embodiments, ellipses can be fitted whose side ratio of semi-minor axis to semi-major axis is more than 0.45, 0.5, 0.6 or even 0.69.

The fitted ellipse 26 thus fills the annular chamber 24 in the most effective possible manner.

Figure 14:
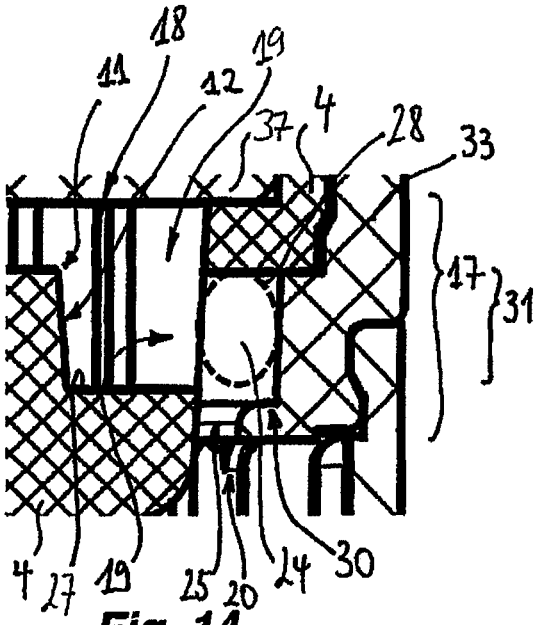
FIG. 14 shows the detail as per FIG. 13 with a small ellipse fitted therein.

It can be seen in FIG. 14 that the collecting chamber 18 has, on the base, a guide surface 27 which guides the inflowing water into the annular chamber 24.

If the guide surface 27 is elongated into the annular chamber 24, it can be seen that, in the annular chamber part 31 thus formed above the guide surface 27, there can be fitted an ellipse 26 whose side ratio of the semi-minor axis to the semi-major axis is approximately 0.69 and thus greater than 0.52 and even greater than 0.55 and greater than 0.6.

This ellipse 28 describes, as a close approximation, the profile of the water flow downstream of the inlet into the annular chamber 24 from the guide surface 27.

This approximately circular path configuration leads to aeration and thus air enrichment before the water emerges to the outlet nozzle 25.

In the illustrations as per FIG. 3, FIG. 13 and FIG. 14, it can be seen that the annular chamber 24 has, transversely with respect to its extent direction, a longitudinal section which has a parallelogram-shaped form. To form a sufficiently narrow outlet nozzle 25, a step-like constriction 30 is thus formed at the outflow-side end of the annular chamber 24.

The outlet nozzle 25 is formed by an encircling annular gap 20 between the diffuser insert 4 and a housing sleeve 33.

It can also be seen in FIG. 3 that the annular chamber 24 is, in a longitudinal section, arranged so as to be offset downward, or toward an outlet 34, in relation to the upstream collecting chamber 18.

It is achieved in this way that, in this longitudinal section, the annular chamber 24 extends both above and below the guide surface 27.

FIGS. 7 to 10 show different views of a further sanitary installation part 1 according to the invention. Components and functional units which are similar or identical in terms of construction and/or function to the exemplary embodiments above are denoted by the same reference designations and will not be described separately again. The statements relating to FIGS. 2 to 6 therefore apply correspondingly to FIGS. 7 to 10.

The exemplary embodiment as per FIGS. 7 to 10 differs from the exemplary embodiment above at least in that the baffle plate 7 is not of entirely planar form, but rather has a ski-jump-shaped elevation 35 at its radially outer end, by which the outlet opening 9 forms a nozzle. The ski-jump-shaped elevation 35 is in this case dimensioned such that the baffle plate 7 is still of substantially planar and obstruction-free design.

Figure 11:
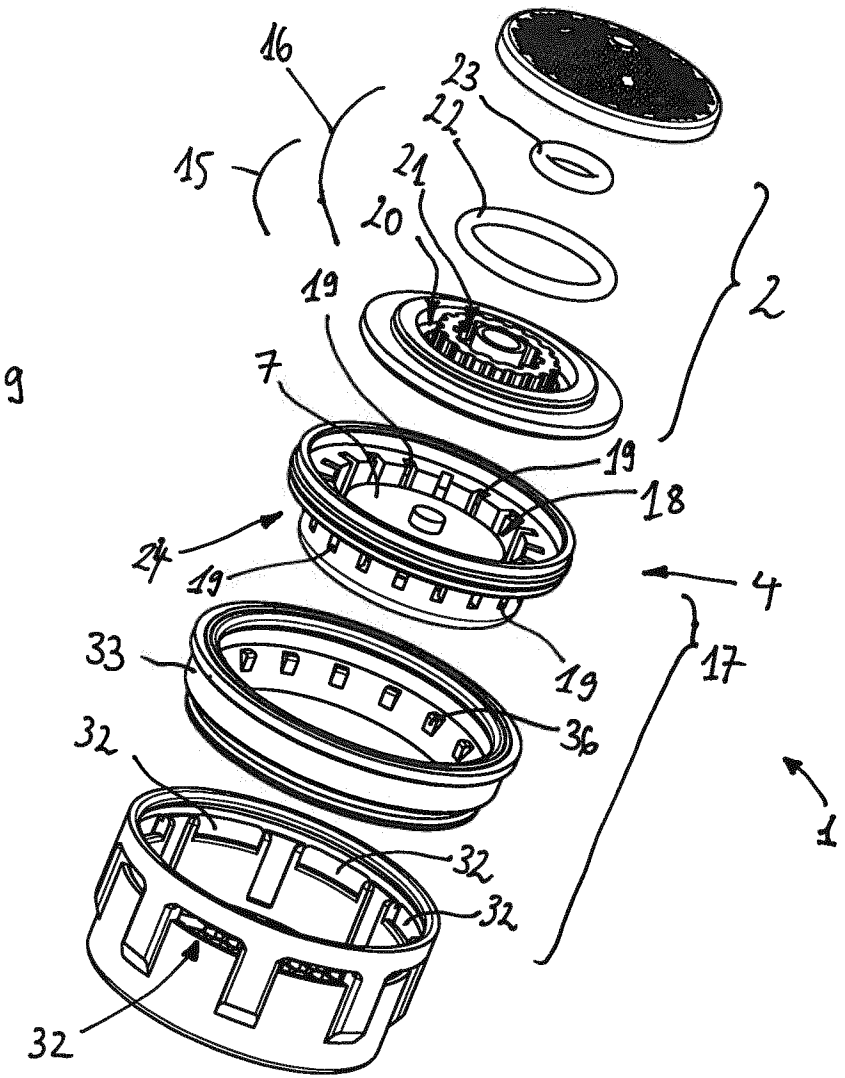
FIG. 11 shows a further sanitary installation part according to the invention in an exploded illustration.
Figure 12:
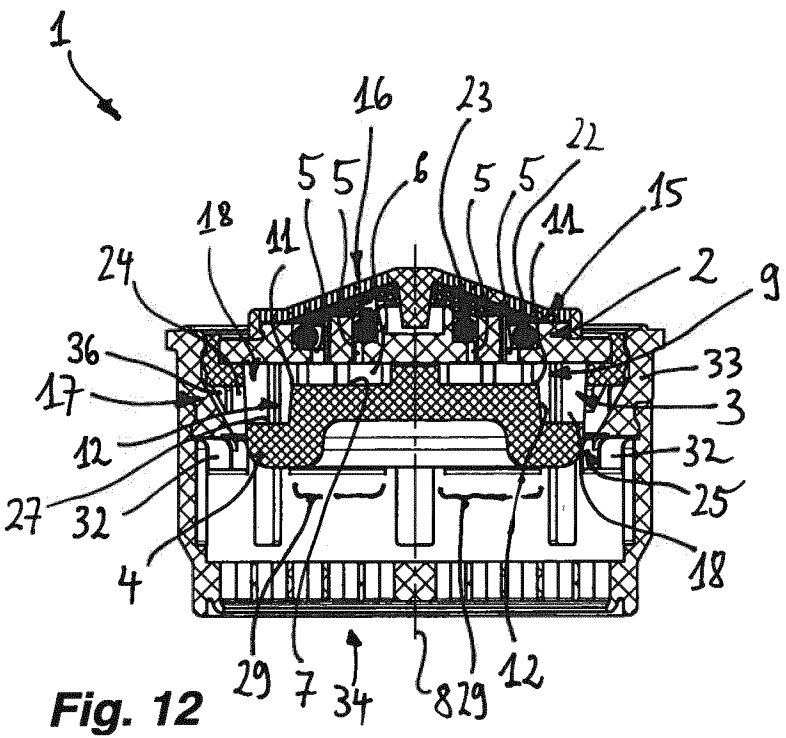
FIG. 12 shows the installation part as per FIG. 11 in a longitudinal sectional illustration.

FIGS. 11 and 12 show a further exemplary embodiment according to the invention of a sanitary installation part 1. Again, components and functional units which are similar or identical in terms of construction and/or function are denoted by the same reference designations and will not be described separately. The statements relating to the exemplary embodiments above therefore apply correspondingly to FIGS. 11 and 12.

The exemplary embodiment as per FIGS. 11 and 12 differs from the exemplary embodiments above in that the annular chamber 24 does not have a parallelogram-shaped cross-sectional form in longitudinal section.

Rather, here, a trapezoidal form is at least approximately realized, in the case of which the upper end of the annular chamber 24 is widened such that the diffuser insert 4 is no longer supported by solid material of the housing sleeve 33. For the support of the diffuser insert 4, plate-like projections 36 are formed here, which project into the annular chamber 24.

These projections 36 serve firstly for holding the diffuser insert 4 and secondly for diverting water flows, which flow along the extent direction of the circular annular chamber 24, in a radially inward direction. This further improves the mixing of the water flows.

These projections 36 are preferably formed correspondingly to the position of the passage openings 19.

Figure 16:
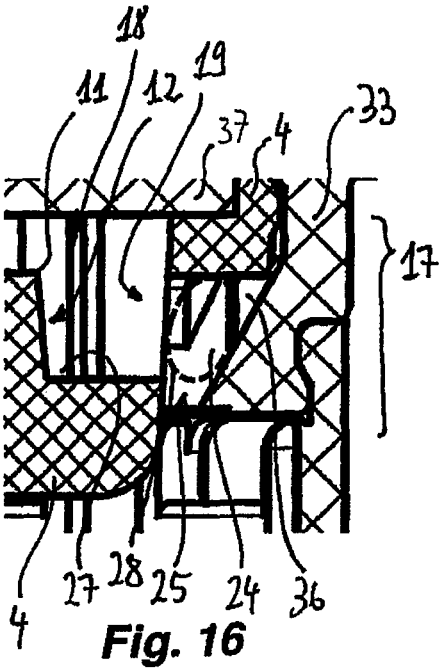
FIG. 16 is an illustration analogous to FIG. 14 for the installation part as per FIG. 12.
Figure 15:
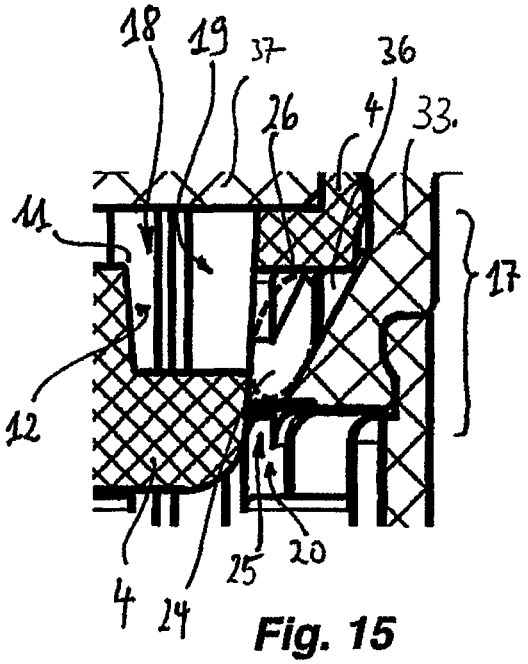
FIG. 15 is an illustration analogous to FIG. 13 showing the installation part as per FIG. 12.

FIGS. 15 and 16 show the ellipses 26, 28 analogously to FIGS. 13 and 14 for the situation of the installation part 1 as per FIGS. 11 and 12.

It can be seen that, due to the particular shaping of the annular chamber 24, the fitted ellipses 26, 28 are oriented obliquely in relation to the central axis 8 which predefines the longitudinal direction of the installation part 1. In the present case, the ellipse 26 has a side ratio of 0.55 of semi-minor axis to semi-major axis, that is to say lies above a ratio of 0.52. By contrast, the ellipse 28 has a side ratio of approximately 0.69 of semi-minor axis to semi-major axis.

Figure 17:
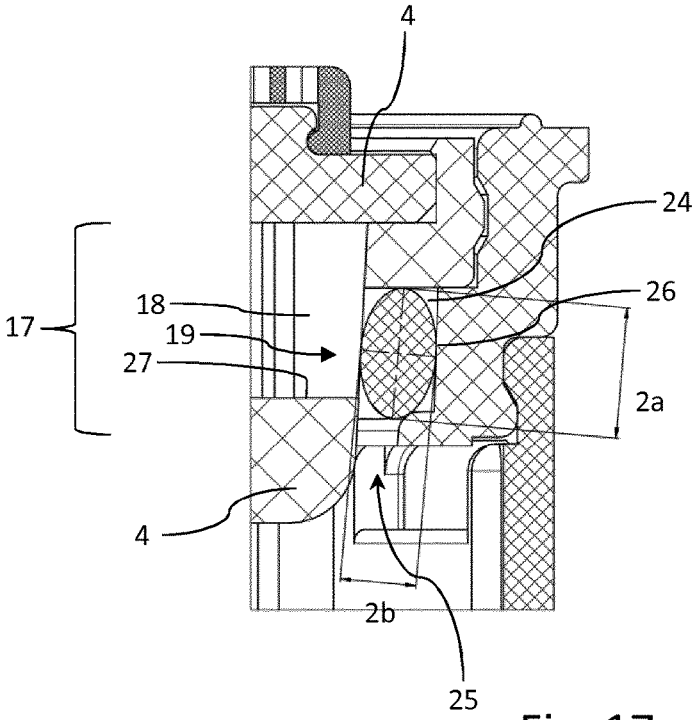
FIG. 17 is an illustration analogous to FIG. 13 of an annular chamber of a further installation part according to the invention.
Figure 18:
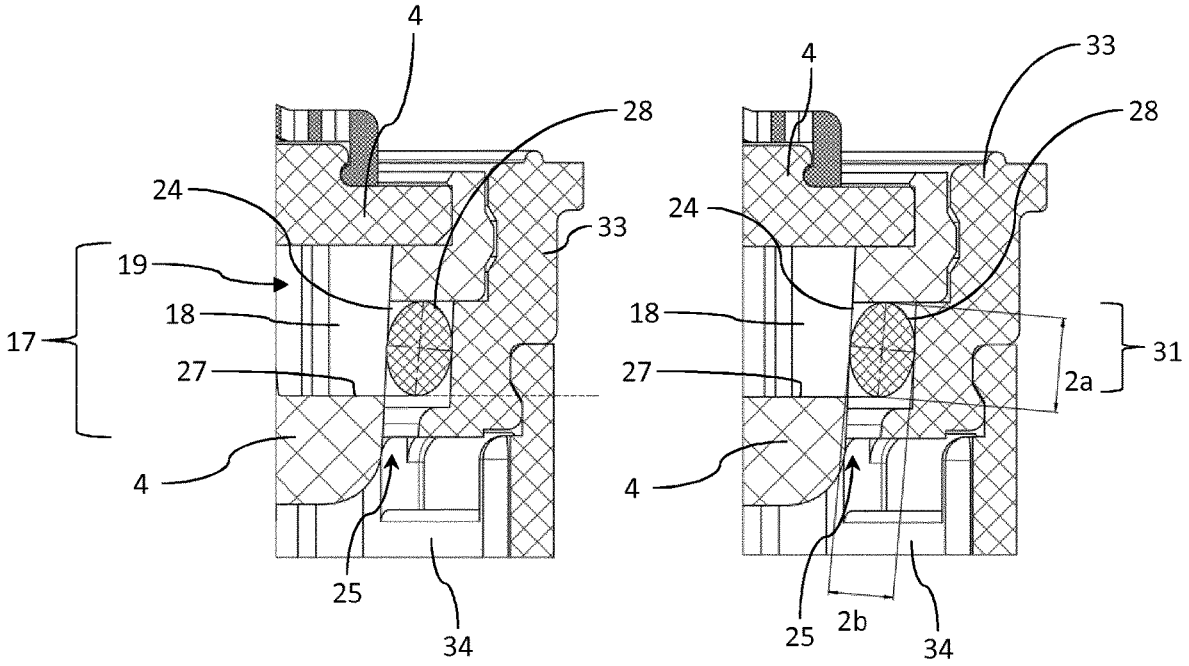
FIG. 18 is an illustration analogous to FIG. 14 of the annular chamber from FIG. 17, wherein the left-hand figure shows the position of the elongated guide surface, and the right-hand figure shows the dimensions of the large and of the small diameter of the ellipse fitted therein.

FIGS. 17 and 18 show illustrations analogous to FIGS. 13 and 14. Components and functional units which are similar or identical in terms of construction and/or function are denoted by the same reference designations and will not be described separately. The statements relating to FIGS. 1 to 16 therefore apply correspondingly to FIGS. 17 and 18.

In FIG. 17, the ratio of semi-minor axis (associated diameter 2*b*) to semi-major axis (associated diameter 2*a*) of the ellipse 26 amounts to 0.55. In FIG. 18, the ratio of semi-minor axis (associated diameter 2*b*) to semi-major axis (associated diameter 2*a*) of the ellipse 26 amounts to 0.69.

Figure 19:
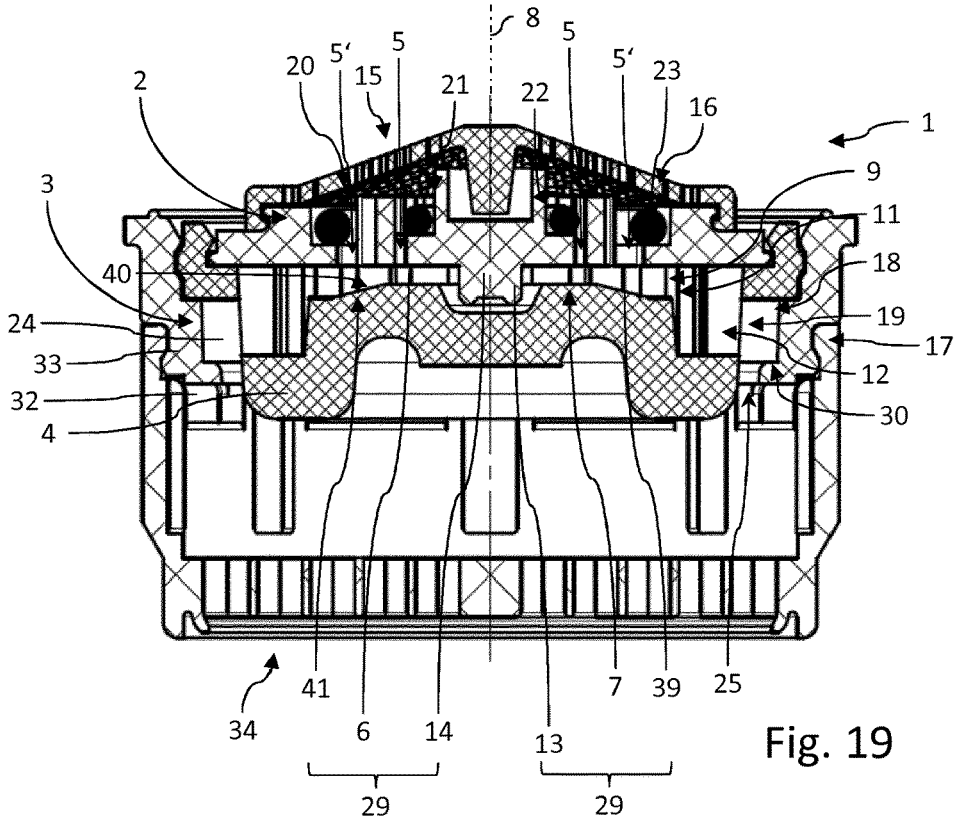
FIG. 19 is a two-dimensional sectional illustration of a further installation part according to the invention.
Figure 20:
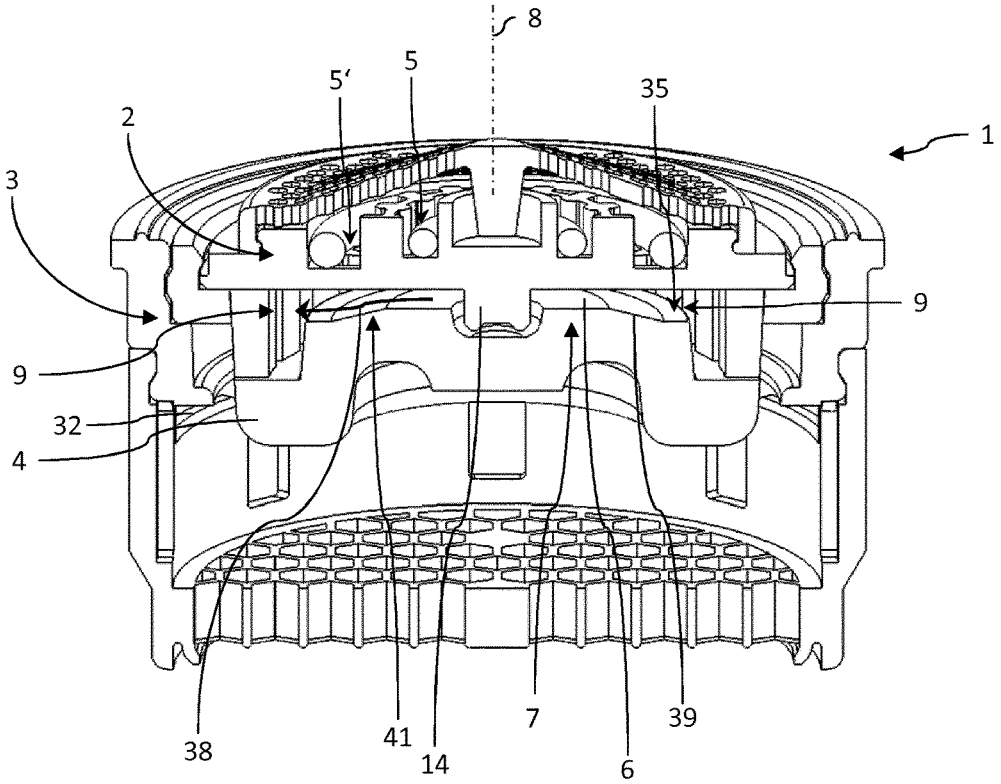
FIG. 20 is a three-dimensional sectional illustration of the installation part as per FIG. 19.
Figure 21:
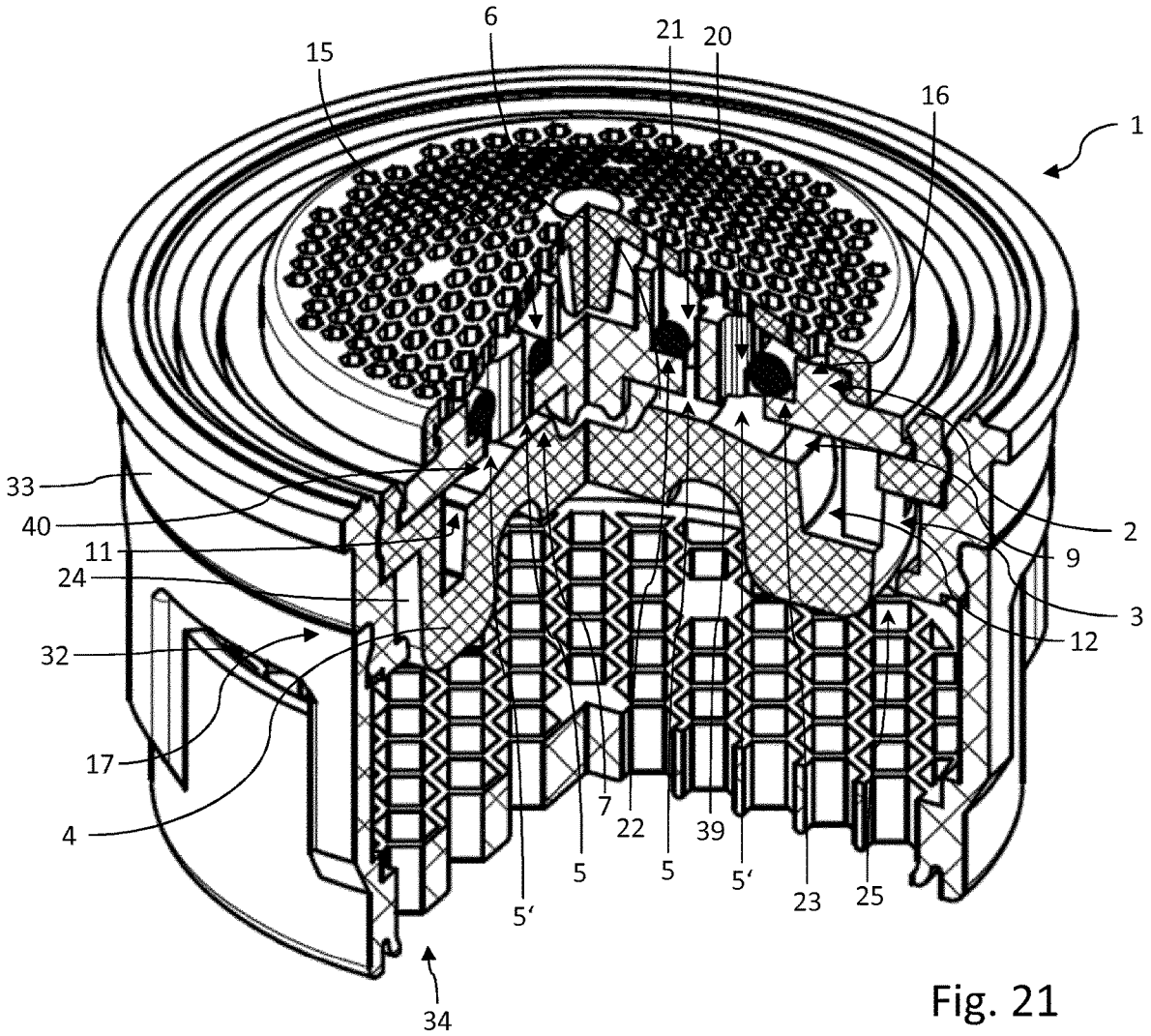
FIG. 21 is a further three-dimensional sectional illustration of the installation part as per FIG. 19.

FIGS. 19 and 20 show different views of a further sanitary installation part 1 according to the invention. These figures will be described jointly below. Components and functional units which are similar or identical in terms of construction and/or function to one of the installation parts above as per FIGS. 1 to 18 are denoted by the same reference designations and will not be described separately again. The statements relating to FIGS. 1 to 18 therefore apply correspondingly to FIGS. 19 and 20.

The installation part 1 as per FIGS. 19 and 20 differs from the preceding exemplary embodiments firstly in that the diffuser space 6 does not have a profile 39 with constant height. Rather, along the main flow direction 38 between the upstream inlet opening 5, which is assigned to the flow regulator 15, and the downstream inlet opening 5', which is assigned to the flow regulator 16, there is formed a profile widening 40 by which the cross-sectional area of the diffuser space 6 of a cylinder envelope around the axis 8 changes, in an outward direction, over-proportionately in relation to the radius of the cylinder envelope. By this increase in area, the additional water flow that enters through the downstream inlet opening 5' into the water flow from the upstream inlet opening 5, can be accommodated without significant turbulence being generated. In further exemplary embodiments, the profile ramp 41 may additionally or alternatively be formed on the functional unit 2. The gradient of the profile ramp 41 is in this case selected such that the profile widening 40 defines an enlargement of an area of a cross-sectional area of the diffuser space 6 transversely with respect to the main flow direction 38, which enlargement is adapted to an area of a cross-sectional area of the downstream inlet opening 5'. It can thus be stated that the area of a cylinder envelope around the axis 8 in the diffuser space 6 downstream of the profile widening 40 is larger, by the area of the downstream inlet opening 5', than the corresponding area upstream of the profile widening 40. Here, the invention utilizes the continuity equation to attain an approximately constant flow speed.

The exemplary embodiment as per FIGS. 19 and 20 furthermore differs from the preceding exemplary embodiments in that the flow divider 14 is formed as a pin not on the baffle plate 8 but—so as to point downward—integrally on the functional unit 2. The functional unit 2 is thus supported on the baffle plate 8 and on the diffuser insert 4.

In the case of the sanitary installation part 1 with a diffuser 3 arranged downstream of a functional unit 2 and with an annular chamber 24 arranged downstream of the diffuser 3, it is provided that an area of an opening cross section of an outlet opening 9 of the diffuser 3 be configured to be at most 10% larger than an area of an opening cross section of an inlet opening 5, 5' of the diffuser 3, and/or that the annular chamber 24 be formed with a contour which, in a longitudinal section of the installation part 1, permits the inscribing of an ellipse 26, 28 with the smallest possible eccentricity.

LIST OF REFERENCE DESIGNATIONS

1 Installation part
2 Functional unit
3 Diffuser
4 Diffuser insert
5 (Upstream) inlet opening
5' (Downstream) inlet opening
6 Diffuser space
7 Baffle plate
8 Central axis
9 Outlet opening
10 Flow obstruction
11 Outer edge
12 Step
13 Support
14 Flow divider
15 Flow regulator
16 Flow regulator
17 Jet aerating device
18 Collecting chamber
19 Passage opening
20 Annular gap
21 Annular gap
22 Regulating element
23 Regulating element
24 Annular chamber
25 Outlet nozzle
26 Ellipse
27 Guide surface
28 Ellipse
29 Flow straightener
30 Constriction
31 Annular chamber part
32 Aeration opening
33 Housing sleeve
34 Outlet
35 Elevation
36 Projection
37 Carrier plate
38 Main flow direction
39 Profile
40 Profile widening

The invention claimed is:

1. A sanitary installation part (1), comprising:

a functional unit (2), a diffuser (3) formed downstream of the functional unit (2), the functional unit (2) forms at least one inlet opening (5, 5') to a diffuser space (6), the diffuser (3) includes a baffle plate (7) which delimits the diffuser space (6) in an incident-flow direction predefined by the at least one inlet opening (5, 5'), said baffle plate is adapted to divert water flowing in through the at least one inlet opening (5, 5') in a lateral direction, the diffuser space (6) is formed between the baffle plate (7) and the functional unit (2) and has an outlet opening (9) through which water entering through the at least one inlet opening (5, 5') is adapted to emerge in its entirety from the diffuser space (6), and an opening cross section of the outlet opening (9) has an area which amounts to 0.9 times to 2 times an area of an opening cross section of the at least one inlet opening (5, 5') wherein the baffle plate (7) is, at a side facing toward the diffuser space (6), formed so as to be planar, free from obstructions, and open in an encircling manner at an outer edge (11) thereof, and comprises a step (12), situated radially outside the edge (11), said step (12) forming a cross-sectional widening in relation to the opening cross section of the outlet opening (9).

2. The sanitary installation part (1) according to claim 1, wherein the diffuser space (6) has at least two inlet openings (5, 5') which are spaced apart from one another along a main flow direction (38), the diffuser space (6) has, along the main flow direction (38), a profile (39) which defines a profile widening (40) at least one of between the mutually spaced-apart inlet openings (5, 5') or at the downstream one of the at least two inlet openings (5, 5'), and the profile widening (40) defines an enlargement of a cross-sectional area of the diffuser space (6) transversely with respect to the main flow direction (38), which is adapted to a cross-sectional area of the downstream inlet opening (5').

3. The sanitary installation part (1) as claimed in claim 1, wherein the at least one inlet opening (5, 5') is at least one of multi-part or divided form, and the at least one inlet opening (5, 5') defines a total inflow area to the diffuser space (6).

4. The sanitary installation part (1) as claimed in claim 1, wherein the baffle plate (7) is delimited on all sides by a cross-sectional widening for the flowing water.

5. The sanitary installation part (1) as claimed in claim 1, wherein the at least one inlet opening (5, 5') is arranged at least one of opposite the baffle plate (7) or in the middle or centrally with respect to the baffle plate (7), and a carrier plate (37) of the functional unit (2) is supported on the baffle plate (7).

6. The sanitary installation part (1) as claimed in claim 1, further comprising a flow divider formed at least one of on the baffle plate (7) or on the functional unit (2), and the flow divider (14) is formed centrally with respect to the inlet opening (5, 5'), in the diffuser space (6).

7. The sanitary installation part (1) as claimed in claim 1, wherein the functional unit (2) includes at least one of a flow regulator (15, 16) or a restrictor.

8. The sanitary installation part (1) as claimed in claim 1, further comprising a jet aerating device (17) positioned downstream of the diffuser (3).

9. The sanitary installation part (1) as claimed in claim 2, wherein the diffuser space (6) has, at least outside the profile widening (40), a substantially constant height.

10. The sanitary installation part (1) as claimed in claim 1, wherein the diffuser space (6) forms a flow straightener (29).

11. The sanitary installation part (1) as claimed in claim 1, wherein t a height of the diffuser space (6) amounts to less than half of the height of a collecting chamber (18) positioned downstream of the diffuser space.

12. A sanitary installation part (1), comprising:

a diffuser (3) including a baffle plate (7) which is adapted to divert inflowing water in a lateral direction, an annular chamber (24) positioned downstream, in a flow direction, of the diffuser (3), said annular chamber opens into at least one outlet nozzle (25), at least one aeration opening (32) formed at an outflow side of the at least one outlet nozzle (25), via which air from outside is supplied for generating an aerated water jet, the annular chamber (24) has, above the at least one outlet nozzle (25), in one longitudinal portion, a contour into which an ellipse (26, 28) is fittable which has a side ratio of greater than 0.433 of a semi-minor axis in relation to a large semi-major axis, wherein the baffle plate (7) is, at an upstream side, formed so as to be planar, free from obstructions, and open in an encircling manner at an outer edge (11) thereof, and comprises a step (12), situated radially outside the edge (11), said step (12) forming a cross-sectional widening in relation to an opening cross section of an outlet opening (9) in communication with the annular chamber (24).

13. A sanitary installation part (1), comprising:

a diffuser (3) including a baffle plate (7) which is adapted to divert inflowing water in a lateral direction, an annular chamber (24) positioned downstream, in a flow direction, of diffuser (3), said annular chamber opens into at least one outlet nozzle (25), at least one aeration opening (32) formed downstream of the at least one outlet nozzle (25), via which air from outside is supplied for generating an aerated water jet, a guide surface (27) formed between the diffuser (3) and the annular chamber (24), the guide surface (27) is adapted to guide inflowing water into the annular chamber (24), the annular chamber (24) has, in an annular chamber part (31) situated above an elongation of the guide surface (27) into the annular chamber (24), in one longitudinal portion, a contour into which an ellipse (26, 28) is fittable which has a side ratio of greater than 0.52 of a semi-minor axis in relation to a semi-major axis, wherein the baffle plate (7) is, at an upstream side, formed so as to be planar, free from obstructions, and open in an encircling manner at an outer edge (11) thereof, and comprises a step (12), situated radially outside the edge (11), said step (12) forming a cross-sectional widening in relation to an opening cross section of an outlet opening (9) in communication with the annular chamber (24).

14. The sanitary installation part (1) as claimed in claim 12, wherein the annular chamber (24) has a tetragonal shape in longitudinal section.

15. The sanitary installation part (1) as claimed in claim 12, further comprising an upper cover placed onto projections which project into the annular chamber (24).

16. The sanitary installation part (1) as claimed in claim 12, wherein the at least one aeration opening comprises multiple aeration openings (32) that are located downstream of the outlet nozzle (25), distributed about a circumference of the installation part (1).

17. The sanitary installation part (1) as claimed in claim 12, wherein the outlet nozzle (25) is formed by an annular gap.

18. The sanitary installation part (1) as claimed in claim 12, wherein the annular chamber (24) is, in a longitudinal section, arranged offset downward in relation to a collecting chamber (18) positioned upstream therefrom.

19. The sanitary installation part (1) as claimed in claim 18, further comprising multiple mutually spaced-apart passage openings (19) formed between the collecting chamber (18) and the annular chamber (24).

20. The sanitary installation part (1) as claimed in claim 13, wherein the annular chamber (24) extends above and below the guide surface (27).

* * * * *